United States Patent [19]

Deforeit

[11] Patent Number: 4,651,611

[45] Date of Patent: Mar. 24, 1987

[54] TOUCH DYNAMICS SIGNAL GENERATOR FOR ELECTRONIC MUSICAL INSTRUMENTS

[75] Inventor: Christian J. Deforeit, Semur-en-Auxois, France

[73] Assignee: Matthew Hohner, Trossingen, Fed. Rep. of Germany

[21] Appl. No.: 671,115

[22] Filed: Nov. 13, 1984

Related U.S. Application Data

[63] Continuation-in-part of Ser. No. 569,579, Jan. 10, 1984, Pat. No. 4,520,706.

[30] Foreign Application Priority Data

Jan. 18, 1983 [DE] Fed. Rep. of Germany ..... 3301354

[51] Int. Cl.[4] ..... G10H 1/18; G10H 7/00

[52] U.S. Cl. ..... 84/1.1; 84/1.27; 84/DIG. 7; 340/365 L

[58] Field of Search ..... 84/1.1, 1.27, DIG. 7; 340/365 L

[56] References Cited

U.S. PATENT DOCUMENTS

| | | | |
|---|---|---|---|
| 3,594,488 | 7/1971 | Ohno | 84/1.1 X |
| 3,617,600 | 11/1971 | Ohno | 84/1.1 |
| 3,652,774 | 3/1972 | Ohno | 84/DIG. 7 |
| 3,902,397 | 9/1975 | Morez et al. | 84/1.1 X |
| 4,111,092 | 9/1978 | Adachi | 84/1.27 |
| 4,213,367 | 7/1980 | Moog | 84/1.1 |
| 4,299,153 | 11/1981 | Hoskinson et al. | 84/1.1 |
| 4,366,463 | 12/1982 | Barker | 84/DIG. 7 |

*Primary Examiner*—S. J. Witkowski

[57] ABSTRACT

The touch dynamics of the operation of keys of an electronic musical instrument are determined through the use of pressure sensitive transducers associated with the keys, the transducers each including a magnetic field responsive semiconductor device and providing signals which are analyzed to determine their variation in magnitude as a function of time. Additionally, after a pre-selected time period, if a key remains operated and the pressure exerted thereon is varied, the output voltage of the key associated transducer will be further analyzed to determine if the player is calling for the reproduction of a secondary effect.

6 Claims, 4 Drawing Figures

TOUCH DYNAMICS SIGNAL GENERATOR FOR ELECTRONIC MUSICAL INSTRUMENTS

CROSS-REFERENCE TO RELATED APPLICATION

This application is a continuation-in-part of application Ser. No. 569,579 filed Jan. 10, 1984 and now U.S. Pat. No. 4,520,706. Application Ser. No. 569,579 claims priority based upon parent German application No. P 33 01 354.3 filed Jan. 18, 1983 and to the extent that this application and parent application Ser. No. 569,579 have a common disclosure the same priority is claimed for this application.

BACKGROUND OF THE INVENTION (1) Field of the Invention

The present invention relates to electronic musical instruments and particularly to improvements in keyboard instruments such as electronic organs. More specifically, this invention is directed to enhancing the quality of sound produced by keyboard-type electronic musical instruments and especially to the generation of signals having electrical characteristics commensurate with the manner in which the keys are operated. Accordingly, the general objects of the present invention are to provide novel and improved apparatus and methods of such character.

(2) Description of the Prior Art

While not limited thereto in its utility, the present invention is particularly well-suited for incorporation in that type of keyboard instrument generally called an "electronic organ". An electronic organ produces audible sound in response to the depression of keys on a keyboard or keyboards. The actuation, i.e., the depression, of a key by the player of a prior art electronic organs typically causes the operation of a switch. A switch, however, can only indicate whether or not the associated key has been touched. Since an electronic organ optimally is selectively employed to simulate various instruments, the simple detection of a switch closure does not provide sufficient information to enable the production of a complex command signal which may be transduced into the tone desired by the player. For example, in the playing of a piano the sound which will be produced will be a function of manner in which each key is depressed by the player, i.e., harder or softer pursuant to the player's interpretation of the musical score. Thus, the typical prior art electronic organ could not simulate a piano with a high degree of realism.

In order to overcome the above-discussed problem it has been proposed to attempt to measure the time required for a key stroke and produce an output signal commensurate with the measured time. This approach is based upon the incorrect assumption that if the measured time is "short" there has necessarily been a "hard" touch while a "long" measured time is indicative of a "soft" key operation.

It is also to be noted that in the playing of various types of musical instruments, string instruments for example, the player will produce desired effects by means of the movements of his fingers while a note is being sounded. The well-known vibrato effect is but one example of a sound quality produced by finger movement during the production of a tone. Previously available electronic keyboard instruments have not been able to successfully simulate "secondary effects" such as vibrato.

SUMMARY OF THE INVENTION

The present invention overcomes the above-discussed and other deficiencies and disadvantages of the prior art by providing for the detection and subsequent generation of signals commensurate with the touch dynamics of the keys of a keyboard-type electronic musical instrument. Apparatus in accordance with the present invention, when added to an electronic musical instrument, permits the simulation of sound commensurate with the dynamics of the key touch and, in a preferred embodiment, also permits simulation of secondary effects such as vibrato.

In accordance with the preferred embodiment, wherein the present invention is employed in an electronic musical instrument having at least one keyboard through which the sounds to be produced are selected, each key is associated with a Hall effect device which generates a signal which is variable as a function of the pressure exerted on the key during its operation. The variation in the signal generated by the Hall effect device is analyzed as a function of time to provide an output signal which is indicative of how hard the key has been struck. In accordance with the preferred embodiment, the rate of change of the voltage generated by the Hall effect device will be delayed in the interest of avoiding the generation of undesired sound.

The preferred embodiment of the present invention, in the interest of generating "secondary effects", also compares the difference in the voltage generated by the Hall effect device associated with a particular key during spaced periods of time to determine whether the player is continuing to operate the key but desires to modulate the tone produced by moving his playing finger.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

Figure 1:
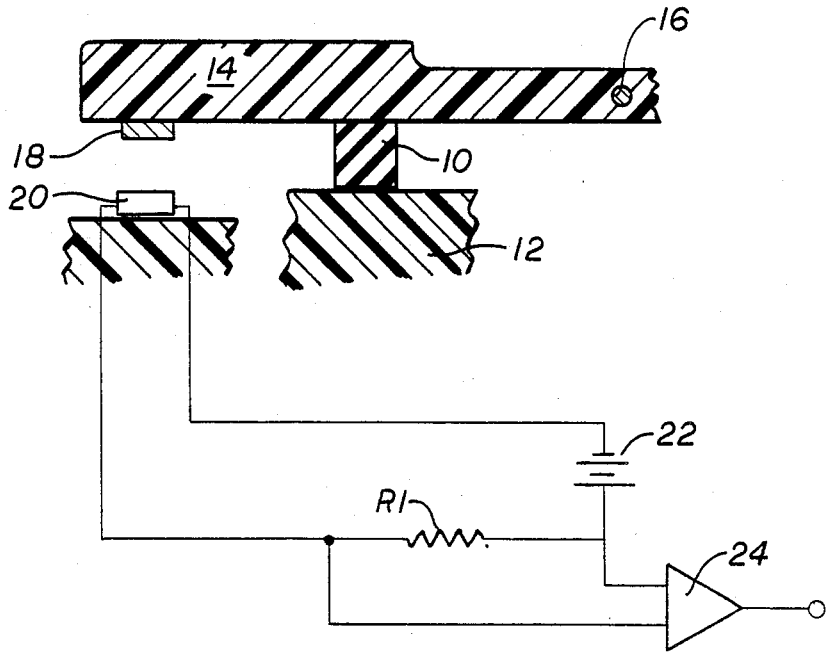
FIG. 1 schematically represents, in a side-elevation view, a first embodiment of a key and associated pressure-sensitive signal transducer which may be employed in the practice of the present invention.

With reference now to the drawing, a pressure sensitive transducer which may be associated with the individual keys of a keyboard-type electronic musical instrument is shown schematically in FIG. 1. In FIG. 1 a block of resilient material 10, comprised for example of a suitable synthetic rubber or other equivalent elastomer, is supported on the stationary frame 12 of a keyboard. The resilient block 10 supports a key 14 at a point intermediate its pivot 16 and the free end thereof. In the disclosed embodiment, a permanent magnet 18 is affixed to the underside of key 14 at a location which is slightly inwardly from the free end of the key. A magnetic field responsive semiconductor 20, for example a Hall effect device, is mounted on the keyboard frame 12 so as to be in alignment with magnet 18. While it would be possible to reverse the positions of magnet 18 and the Hall effect device 20, this would necessitate the running of wires through the key and thus the preferred arrangement is as shown.

As is well-known in the art, a Hall effect device is comprised of a semiconductive material, such as silicon, which is biased by a magnetic field. That is, the magnitude of the current which will flow in a circuit including a Hall effect device will be a function of the strength of a magnetic field to which the semiconductor is exposed. In the apparatus shown in FIG. 1, the proximity of magnet 18 to the Hall effect device 20 will be a function of the pressure applied to key 14 by the musician, the resilient block 10 being compressed in response to the applied finger pressure and generating a restoring force. The current which flows through the circuit including the Hall effect device 20 will be supplied by a source, indicated in the drawing as a battery 22, and a voltage directly proportional to the relative positions of magnet 18 and Hall effect device 20 will be developed across a resistor R1. This voltage is applied as the input to an inverter 24. The output of inverter 24, i.e., a voltage $V_{30}$ will appear at output terminal 30. This voltage will be inversely proportional to the pressure being applied to key 14 at any instant, i.e., the voltage at terminal 30 will vary inversely with the finger pressure applied by the player to key 14.

Figure 2:
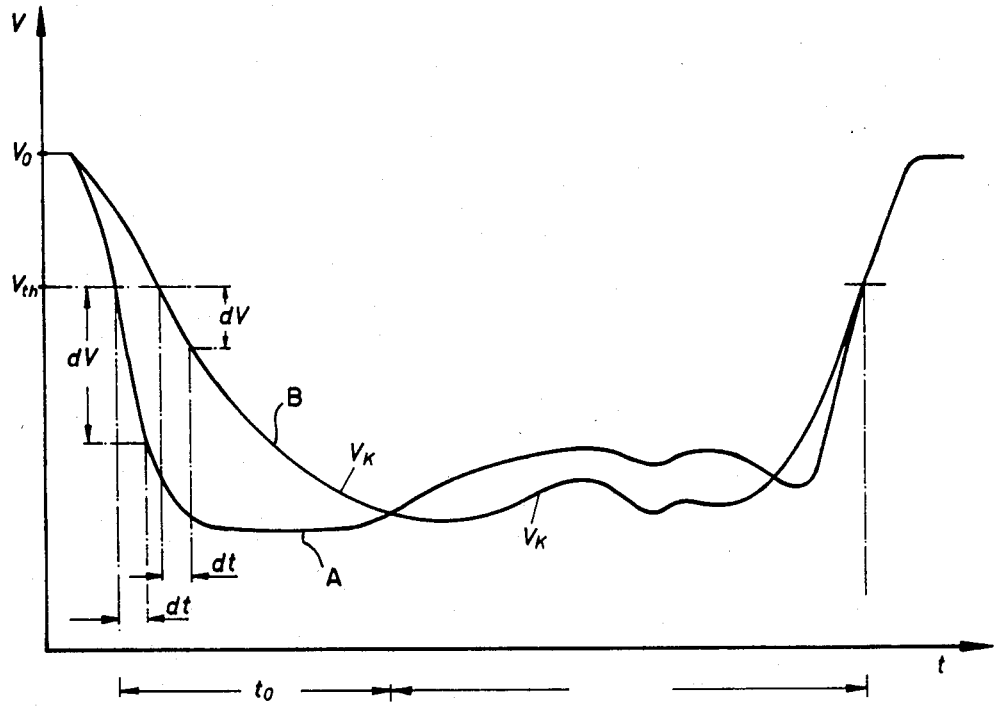
FIG. 2 is a representative voltage/time characteristic curve which would be generated employing the apparatus of FIG. 1.

FIG. 2 graphically depicts a typical output voltage $V_{30}$ which could be produced by the embodiment of FIG. 1, as a function of time. In FIG. 2 curve A represents a forceful key touch while curve B represents a softer touch. As will be described in greater detail below in the discussion of FIG. 3, the voltage $V_{30}$ is processed as soon as it drops below a preselected threshold voltage $V_{th}$. The desired information regarding the touch dynamics, i.e., the manner in which the key has been actuated by the player, may be obtained by calculating the slope of the voltage curve, by determining the time interval during which a pre-determined decrease in voltage has occurred or by determining the voltage drop dV which occurs during a given time interval dt after the voltage $V_{30}$ has dropped below the threshold voltage $V_{th}$. In the disclosed embodiment of the present invention the latter technique is employed. Additionally, after the lapse of a pre-determined time $t_o$, for example 50 msc, it can be assumed that even a very soft key touch has been completed. The player can now cause the simulation of secondary effects such as vibrato by varying key pressure. The changes in the voltage $V_{30}$ after period $t_o$ has elapsed must therefore be processed in a different manner than the initial touch dynamics information, i.e., the force of the original stroke, and as a function of which secondary effect the player wishes to produce. If the voltage $V_{30}$ rises above the level $V_{th}$ it is assumed that the key has been released.

In summary, in order to produce a signal commensurate with the dynamics of the key stroke and any secondary effects desired by the player, the circuitry associated with the transducer embodiment of FIG. 1 must fulfill the following functions for each key:

(1) Determination of whether $V_{30}$ has dropped below $V_{th}$, (2) Determination of dV/dt, (3) Determination of the passage of time $t_o$, (4) Determination of changes in voltage $V_{30}$ after time $t_o$, and (5) Determination of when $V_{30}$ returns to a level greater than $V_{th}$.

Figure 3:
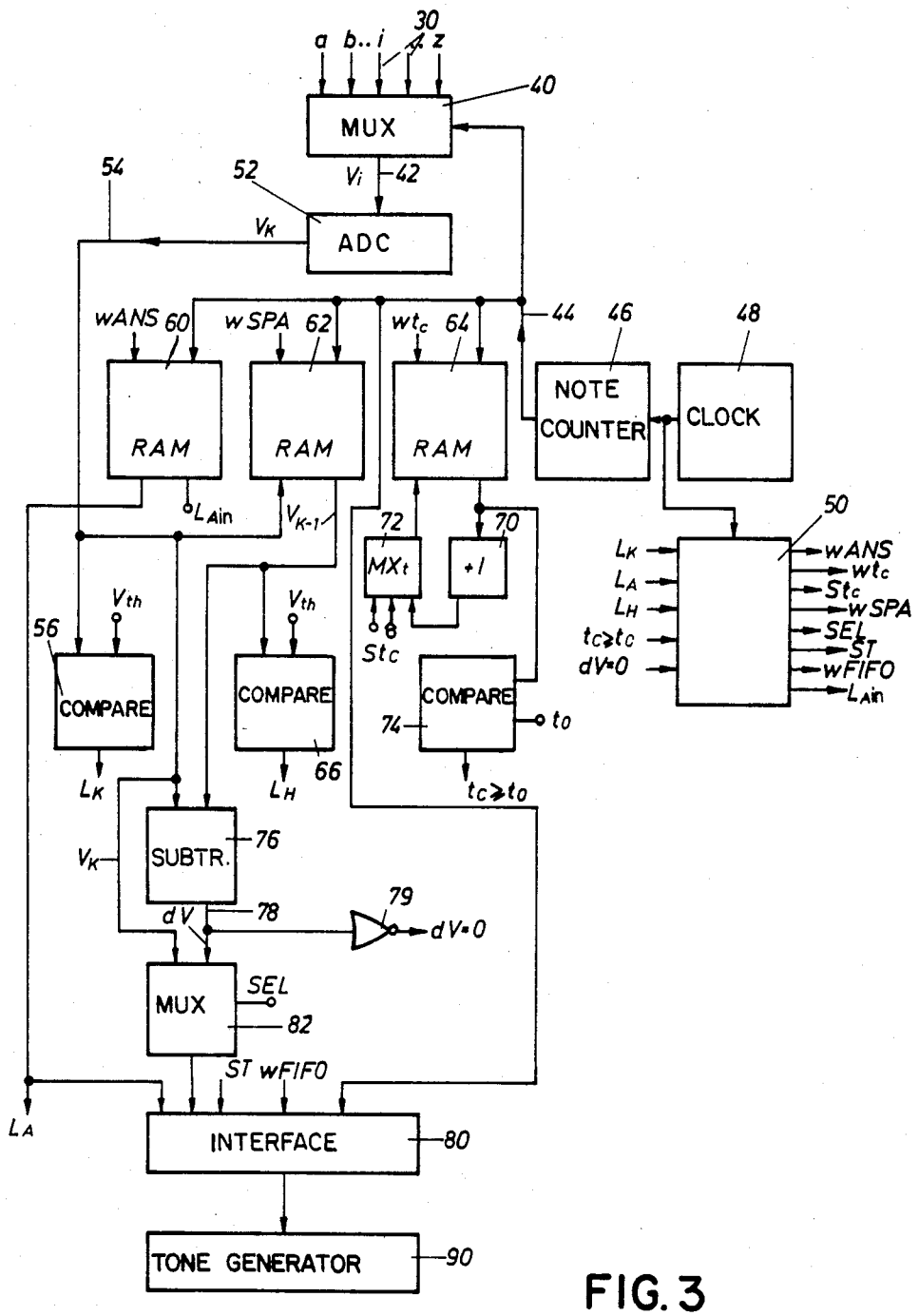
FIG. 3 is a functional block diagram of a first embodiment of signal generation circuitry for use in association with the apparatus of FIG. 1.
Figure 4:
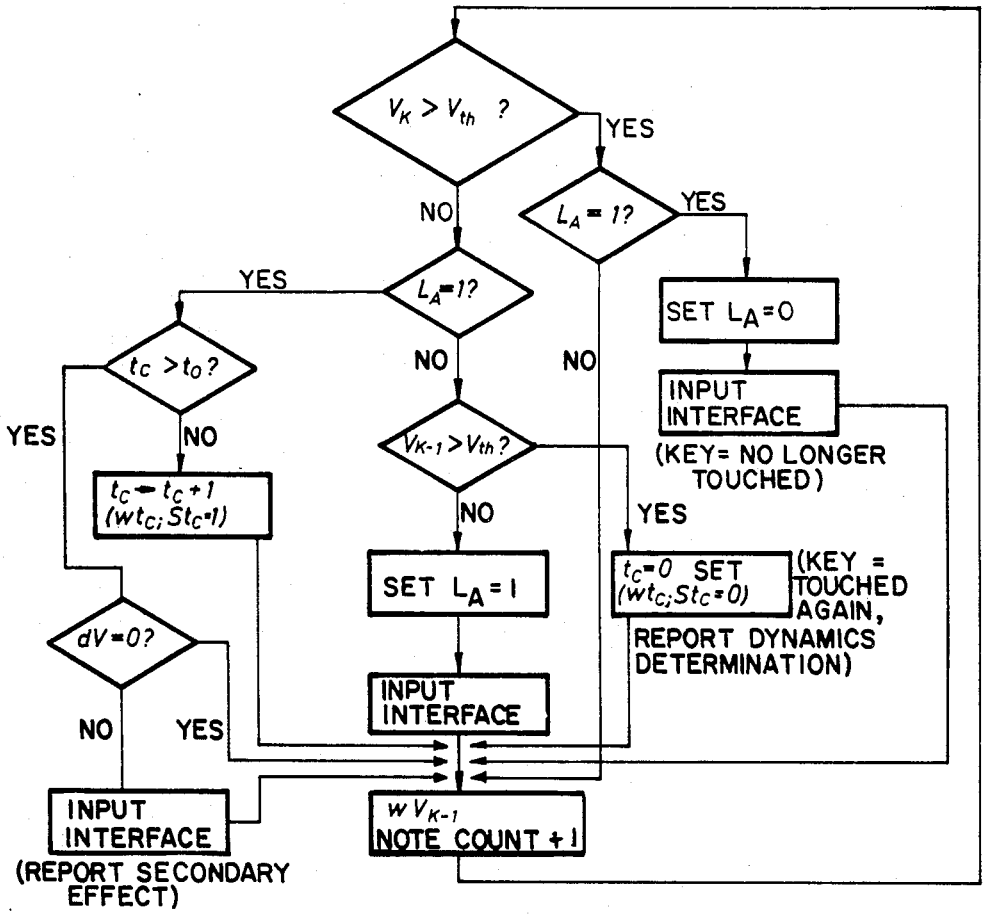
FIG. 4 is a data flow diagram which represents and explains the operation of the circuit of FIG. 3.

Referring simultaneously to FIGS. 3 and 4, circuitry for accomplishing the above-enumerated functions will now be described. The analog signals, i.e., the voltages $V_{30}$a, b,—i—z, from the individual key associated transducers are converted into serial data in a multiplexer circuit 40. This serial data, which is present at the output 42 of multiplexer 40, is delivered to an analog-to-digital convertor 52. The timing of multiplexer 40 is controlled, via conductor 44, by the output of a note counter 46 which, in turn, is controlled by a clock generator 48. The clock generator 48 also clocks a logic circuit 50 which performs the functions to be discussed below.

Analog-to-digital convertor 52 converts the input voltages $V_i$ serially delivered thereto to corresponding digital signals $V_k$. The digital data $V_k$ is supplied as a first input to a comparator 56 and as inputs to a random access memory 62, a subtraction circuit 76 and a multiplexer 82. The second input to comparator 56 is a digital signal which corresponds to the threshold voltage $V_{th}$. Comparator 56, accordingly, provides output logic levels $L_k$ which are indicative of whether the voltages $V_i$, indicative of the states of operation of the serially scanned keyboard circuit, have dropped below the threshold level.

The circuit of FIG. 3 includes three random access memories 60, 62 and 64. These three RAM's will each have at least as many storage locations as there are inputs to the multiplexer circuit 40. Accordingly, each key contact will have an addressable storage location in each RAM. In the cycling of multiplexer 40 data commensurate with the operation of each key will be stored at its unique memory location. Memory 60, i.e., the "touch memory", will hold data commensurate with the touch condition of the keys. Memory 62 will hold the current values of the voltages $V_k$ and thus may be referred to as the "voltage memory". Memory 64 is the "time memory" which stores the current value of time. The three RAM's are addressed by note counter 46 in synchronism with the timing of the multiplexer circuit 40.

The logic level $L_k$ which appears at the output of comparator 56 functions as one of the control inputs to logic circuit 50. The logic level $L_k$ will indicate key state, i.e., that a key has just been deliberately operated or that the key had already been operated during the previous cycle of the multiplexer. The appearance of the logic level $L_k$ commensurate with key operation at the output of comparator 56 will cause logic circuit 50 to generate a $L_{Ain}$ command which causes read-out of the coordinates of the corresponding storage location in "touch" memory 60 and a touch status logic level $L_A$. The $L_A$ information read out of RAM 60 is delivered as an input to logic circuit 50 and also comprises input information for the tone generation circuits of the instrument.

In order to determine if the respective key was already depressed when logic level $L_k$ is outputted by comparator 56 during sequencing, the $V_k$ data generated during the previous multiplex cycle will be compared with the threshold level $V_{th}$ in a second comparator 66. Since the value $V_k$ delivered to comparator 66 will have been stored in RAM 62 during the previous multiplex cycle this data may be referred to as the level $V_{K-1}$. The comparator 66 will provide a logic level $L_H$, which is delivered as an input to logic circuit 50, when $V_{k-1}$ is less than $V_{th}$. The receipt of signal $L_H$ will cause logic circuit 50 to deliver a "write" command wANS to "touch" memory 60. The memory 60 will thus store, at each memory location, $L_A$ information in the form of a logic "1" or "0" commensurate with whether or not the corresponding keys had been in the actuated condition during the preceeding multiplex cycle.

If the $L_A$ signal outputted from memory 60 is at a logic level indicative of a first pressing of the key, two events will be triggered. Firstly, measurement of the time interval $t_o$ will be initiated. Secondly, the touch dynamics will be determined.

For the first event, i.e., the measurement of interval $t_o$, the appropriate storage location in "time" memory 64 is set to zero by command Stc from logic circuit 50. The stored value is read-out, incremented by one unit through the use of an addition circuit 70 and the incremented value is written into memory 64 via multiplexer circuit 72. This procedure will continue until the current time value $t_c$ is equal to the pre-determined interval $t_o$. The current time value $t_c$ stored in RAM 64 is compared with a signal commensurate with the pre-determined interval $t_o$ in a comparator 74. The output logic level of comparator 74 is fed back as a control signal to logic circuit 50 since, subsequent to the time when $t_c$ equals $t_o$, the voltage data $V_k$ must be analyzed in a manner commensurate with the desired secondary effect. The logic circuit 50 also generates an appropriate command ST which enables the time measuring process to be recognized as finished for the particular key.

Logic circuit 50 will generate the command wSPA when t is greater than one multiplexer cycle and $L_A$ indicates that the corresponding key had previously been actuated. Upon delivery of the wSPA command to RAM 62, the stored $V_{K-1}$ data will be read out to a subtraction circuit 76. The current voltage value $V_k$ is subtracted from value $V_{k-1}$ in subtraction circuit 76. Accordingly, data commensurate with the voltage difference dV will appear at the output 78 of subtraction circuit 76. The associated time interval is the time necessary to complete one multiplex cycle. Obviously, if the value dV is zero there is no voltage difference to analyze. All bits of the calculated dV value are inputted to a gate 79 which provides, as its output signal, a logic level indicative of all bits showing a voltage difference of zero. If all bits of dV are not zero and tc is greater than $t_o$, a "secondary effect commanded" signal will be generated.

The touch dynamics will be determined, by circuitry which does not comprise part of the present invention, from the dV signal provided at the output of subtraction circuit 76 when the output of gate 79 is not "zero". The touch dynamics information bearing signal is commensurate with the decrease in the voltage $V_{30}$ occurring during the first multiplex cycle time $t_o$ occurring subsequent to the generation of the $L_k$ signal by comparator 56.

As soon as the touch dynamics have been determined from the value dV, this value can be continued to be used as information from which the desired secondary effect will be determined. Alternatively, the actual signal level $V_k$ may be employed for determination of whether the player is calling for a secondary effect. Accordingly, the output of convertor 52 and the output of subtraction circut 76 are provided as inputs to a multiplexer 82 which functions as a data selection circuit under the command of an SEL signal provided by logic circuit 50. The output signal passed through selection multiplexer 82 is delivered as one of the inputs to an output interface 80. Interface 80 additionally receives the $L_A$ signal from RAM 60, the ST status signal from logic circuit 50, the output of note counter 46 and a wFIFO control signal, which will be discussed below, which is also provided by logic circuit 50. The interface 80 is informed, by means of the status signal ST, whether the signal inputted thereto via selection multiplexer 82 constitutes the measurement of touch dynamics, i.e., $t_o$ not yet elapsed, or of the secondary effect.

The interface 80 is constructed as shift register from which the input data can be read out asychronously with the clock from clock generator 48. The information read from interface 80 is delivered to tone generating circuits 90 of the instrument. The outputs of note counter 46 and "touch" memory 60 will serve to identify the key which is associated with the other data simultaneously delivered to the tone generating circuits. Data is read into the shift register comprising interface 80 by means of the wFIFO command from logic circuit 50. The shift register, i.e., interface 80, will be a device in which the first inputted data will also be the first data to be read out, i.e., device 80 will be a "FIFO register".

Logic circuit 50 may be comprised of a read-only memory or a system of gates. Those skilled in the art, through reference to FIG. 4, could program a read-only memory to function as logic circuit 50. The entire circuit depicted in FIG. 3, with the exception of multiplexer 40, can take the form of a microprocessor such as, for example, INTEL type 8020.

When a previously touched key is released the output levels of comparators 56 and 66 will automatically and serially change.

The circuit represented by the functional block diagram of FIG. 3 will operate in a manner which will be obvious to those of ordinary skill in the art, particularly when simultaneous reference is made to the flow diagram of FIG. 4 and to FIG. 3.

It is to be understood that the present invention is not limited to the embodiment described and shown herein, which is deemed to be merely illustrative of the best most of carrying out the invention, and which is susceptible of modification of form, size, arrangement of parts and details of operation. The invention rather is intended to encompass all such modifications which are within its spirit and scope as defined by the claims.

What is claimed is:

1. In an electronic musical instrument, the instrument having at least a first keyboard with moveable keys for selecting the sounds to be produced, the instrument further having tone generator circuitry for providing analog electrical signals which may be transduced into the selected sounds in response to electrical signals generated upon operation of the keys, the improvement comprising:

transducer means associated with each key, said transducer means each comprising magnetic field responsive signal generator means for providing an output signal which is variable as a function of the pressure exerted on the associated key;

electrical power supply means connected to said signal generator means whereby voltages which vary as a function of the pressure exerted on the keys will be generated by said transducer means;

clock means for generating timing signals;

multiplexer means, said multiplexer means cyclically serially sampling the voltages generated by said transducer means and individually passing the sampled voltages;

means for converting the voltages passed by said multiplexer means into digital data;

means establishing a threshold pressure level and generating a signal commensurate therewith;

first comparator means for comparing the digital data provided by said converting means during each cycle of said multiplexer means with said signal commensurate with the threshold pressure level and generating a first control signal indicative of the achievement of equality therebetween;

second comparator means responsive to digital data commensurate with the voltages generated by each of said transducer means during the next preceding cycle of said multiplexer means and to said signal commensurate with the threshold pressure level for generating a second control signal indicative of a previous achievement of equality therebetween; and means responsive to said first and second control signals and to said timing signals and said transducer means generated voltages for generating signals commensurate with the variation with time and within a range bounded by said threshold pressure level signal of said transducer means generated voltages subsequent to said generated voltages having reached values commensurate with the threshold level.

2. The apparatus of claim 1 wherein said second comparator means includes:

first memory means for storing digital data provided by said converting means, said first memory means having a storage location for each key.

3. The apparatus of claim 1 further comprising:

means providing a command signal a predetermined time subsequent to the generation of a control signal by said second comparator means; and means responsive to said command signals and to said signals commensurate with said transducer means generated voltages for providing a signal indicative of a continued exertion of pressure on an operated key, variation of said signal commensurate with a continued exertion of pressure indicating the desire to simulate a secondary tonal effect.

4. The apparatus of claim 2 wherein said means for analyzing further includes:

means providing command signals a predetermined time subsequent to the generation of a control signal by said second comparator means; and means responsive to said command signals for providing an indication that the output signals of said first comparator means are indicative of the desire to create a secondary tonal effect.

5. In an electronic musical instrument, the instrument having at least a first keyboard with moveable keys for selecting the sound to be produced, the instrument further having tone generator circuitry for providing analog electrical signals which may be transduced into the selected sounds in response to electrical signals generated upon operation of the keys, the improvement comprising:

transducer means associated with each key, said transducer means each comprising a Hall effect device and a permanent magnet, relative movement between said magnet and Hall effect device being produced by key operation whereby said Hall effect device will provide an output signal which is variable as a function of the proximity of said magnet to said Hall effect device;

means resiliently biasing said magnets and cooperating Hall effect devices apart;

electrical power supply means connected to said Hall effect devices whereby voltages which vary as a function of the pressure exerted on the keys to overcome the bias of said biasing means will be generated by said Hall effect devices;

clock means for generating timing signals;

multiplexer means, said multiplexer means serially cyclically sampling the voltages generated by said transducer means and providing output signals commensurate with the sampled voltages;

means establishing a threshold pressure level and generating a signal commensurate therewith;

first comparator means for comparing said signal commensurate with a threshold pressure level with the signals provided by said multiplexer means and for generating enable signals when the signals provided by said multiplexer means achieve equality with the signal commensurate with said threshold pressure level;

first memory means for storing at separate memory locations the signals serially produced by said multiplexer means; and means coupled to said first memory means and responsive to the enabling signals generated by said first comparator means for comparing the signals provided by said multiplexer means with the corresponding signals stored in said first memory means during the previous multiplexer cycle and generating output signals commensurate with differences therebetween, said difference output signals being indicative of the forcefulness with which the associated keys have been touched.

6. The apparatus of claim 5 further comprising:

means providing a command signal a predetermined time subsequent to the generation of an enabling signal by said first comparator means; and means responsive to the generation of a command signal for continuing the operation of said second comparator means and for indicating that any variation in said difference output signals corresponds to a desired secondary effect.

* * * * *